US006134719A

United States Patent [19]

Kuo

[11] Patent Number: 6,134,719

[45] Date of Patent: Oct. 24, 2000

[54] HELMET WINDSHIELD WITH SUNSHADE DEVICE

[75] Inventor: Chao-Yen Kuo, Tainan, Taiwan

[73] Assignee: Kin Yong Lung Industrial Co., Ltd., Tainan, Taiwan

[21] Appl. No.: 09/450,029

[22] Filed: Nov. 29, 1999

[51] Int. Cl.[7] ..... A42B 3/22

[52] U.S. Cl. ..... 2/424; 2/12

[58] Field of Search ..... 2/6.3, 6.4, 6.5, 2/6.7, 9, 10, 12, 15, 424, 432, 422

[56] References Cited

U.S. PATENT DOCUMENTS

| | | | |
|---|---|---|---|
| 5,131,101 | 7/1992 | Chin | 2/424 |
| 5,699,556 | 12/1997 | Chen | 2/9 |
| 6,006,366 | 12/1999 | Vondrak | 2/424 |

*Primary Examiner*—Michael A. Neas
*Attorney, Agent, or Firm*—Rosenberg, Klein & Lee

[57] ABSTRACT

A helmet windshield is provided with sunshade device on the top. The sunshade device includes a supporting slice, a pushing block, a slider, a pivotal block and a sunshade slice. The protrusive member of the pushing block is inserted in the opening in the center of the supporting slice and then attached to by the slider. The left and right sides of the slider are inlaid in the sliding groove provided in the inner surface of the supporting slice and surrounding the opening so that the slider can slide upward and downward in the sliding groove. The ⬭-shape protrusion of the pivotal block is inserted through the ⬭-shape hole of the supporting slice, and the post of the slider is inserted in the hole of the pivotal block. At last, the sunshade slice is combined with the pivotal block by a rivet so that the sunshade slice can move upward or downward according to the movement of the pushing block.

2 Claims, 5 Drawing Sheets

HELMET WINDSHIELD WITH SUNSHADE DEVICE

BACKGROUND OF THE INVENTION

1. Field of the Invention

The present invention relates to a helmet windshield equipped with a sunshade device, and more particularly to a helmet windshield with sunshade device which makes available with the helmet windshield a sunshade that may be retracted out of the way while not being used.

2. Description of the Related Art

For the sake of safety, it is necessary for a rider to wear a helmet when riding a motorcycle. A conventional helmet windshield does not have any sunshade device so that a rider must additionally wear a pair of sunglasses to protect his eyes from intense sunlight. When the sunlight becomes less intense, or the use of sunglasses becomes no longer necessary, a rider must stop riding in order to take off his helmet and sunglasses, store the sunglasses, then put his helmet on again before continuing to ride. This not only wastes time but also increases the potential for an accident.

SUMMARY OF THE INVENTION

Therefore, the present invention provides a helmet windshield having a sunshade device which substantially obviates the drawbacks of the prior art.

An object of the present invention is to provide a helmet windshield with sunshade device that makes available with the helmet windshield a sunshade function so as to protect a rider's eyes against intense sunlight.

Another object of the present invention is to provide a helmet windshield with sunshade device having a pushing block that may be easily displaced upward and downward by a user while riding to move a sunshade slice between activated and retracted positions.

To realize these advantages, the present invention provides a helmet windshield equipped with a sunshade device at an upper portion. The sunshade device includes a supporting slice, a pushing block, a slider, a pivotal block, and a sunshade slice. A protrusive member of the pushing block is inserted into an intermediate opening formed in the center of the supporting slice and attached to the slider. The sides of the slider are retained within a sliding groove formed in an inner surface of the supporting slice to surround the intermediate opening. The slider is slidable upward and downward within the sliding groove. The pivotal block is formed with a protrusion having a sectional contour corresponding to a predetermine polygonal contour of an engagement hole of the supporting slice such that it engages the engagement hole in releasable manner. The slider is formed with a slider post which inserts into the hole of the pivotal block. The sunshade slice is combined with the pivotal block by a rivet so that the sunshade slice can move upward or downward according to the movement of the pushing block.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
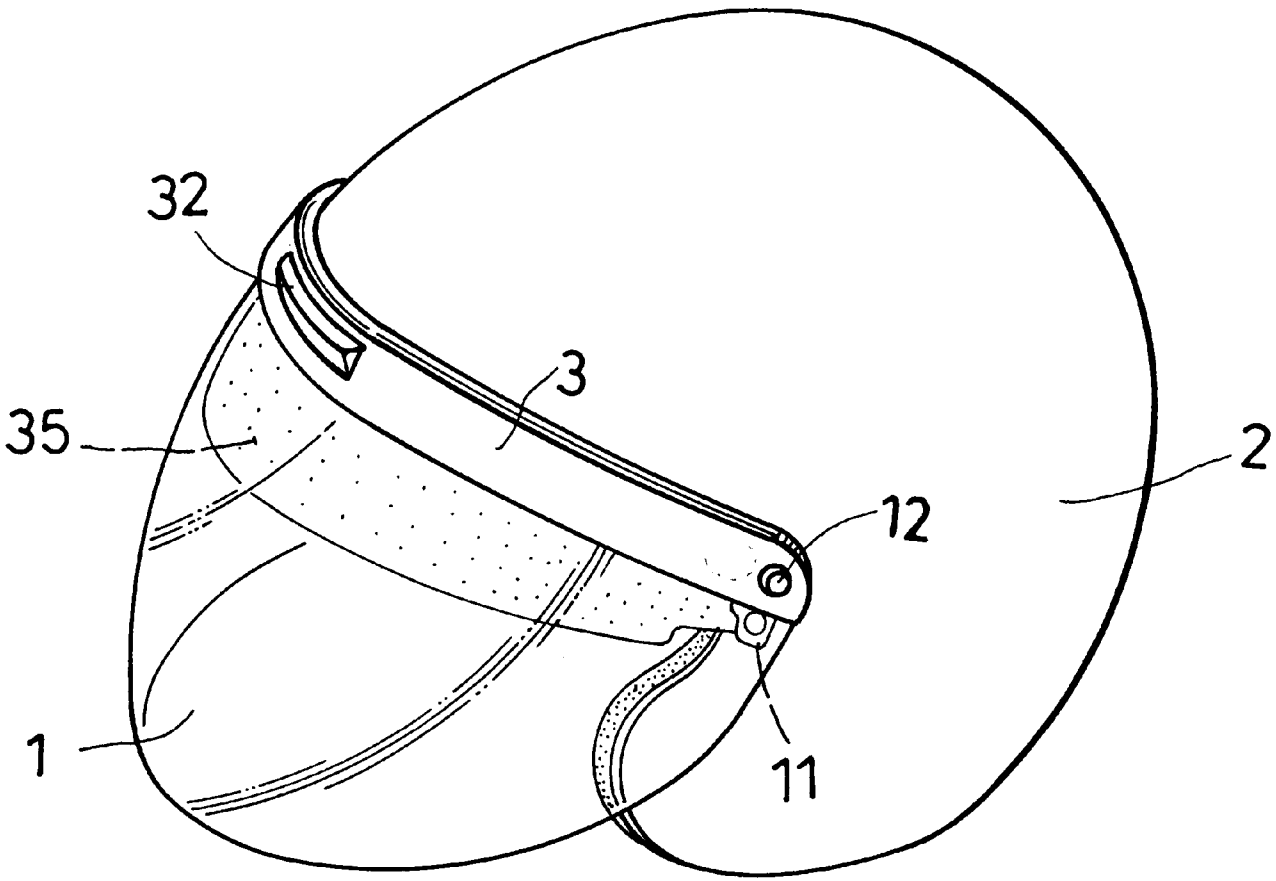
FIG. 1 is a perspective view of an embodiment of the present invention shown installed on a helmet.
Figure 2:
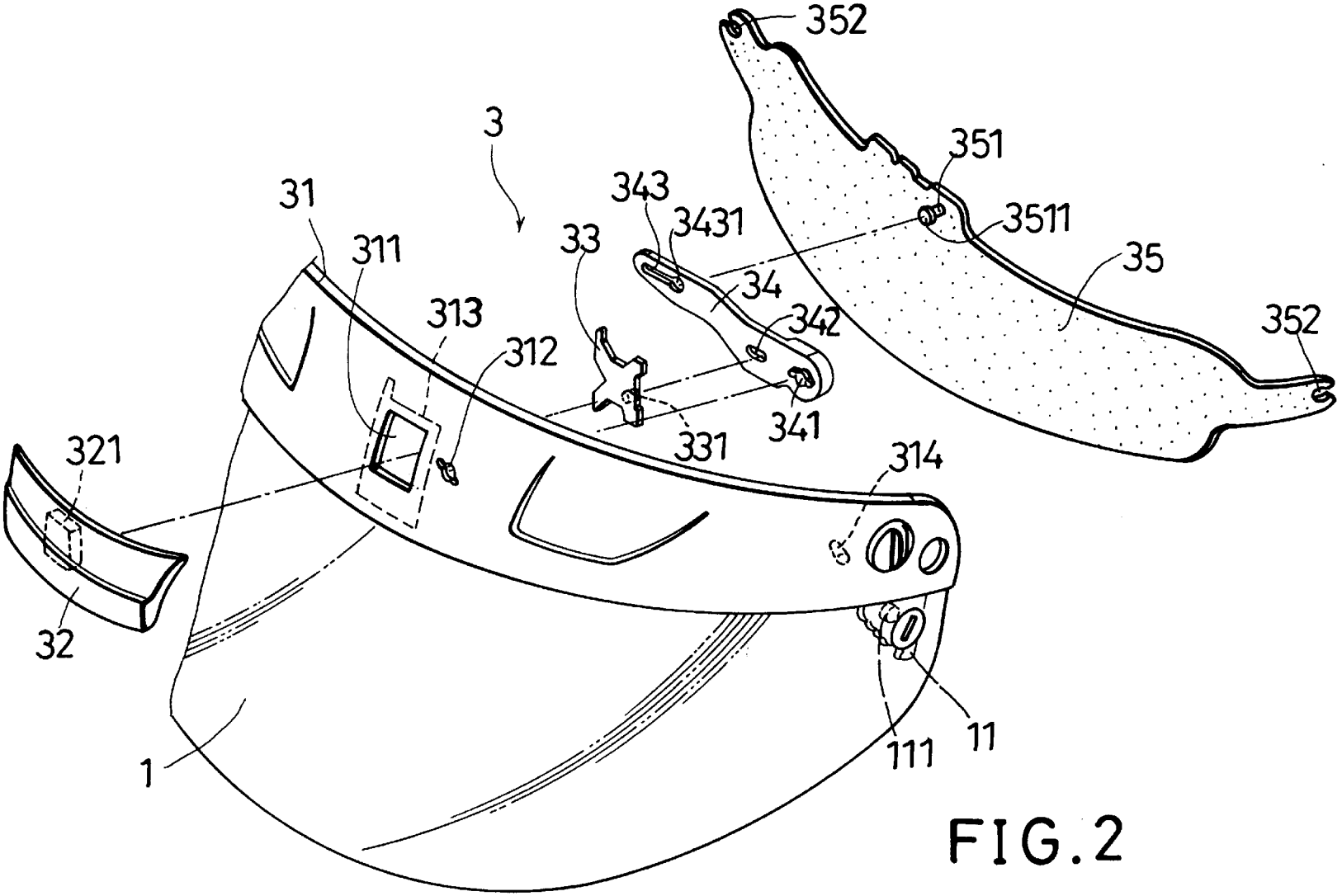
FIG. 2 is a perspective exploded view of an embodiment of the helmet windshield with sunshade device in accordance with the present invention.

Referring to FIGS. 1 and 2, the helmet windshield 1 in the present invention is transparent, and each end is provided with a pivotal member 11 for pivotal coupling to a side of a helmet 2 by a rivet 12 so that the windshield 1 can move upward or downward on the helmet 2. The pivotal member 11 is provided with an inserting post 111. A sunshade device 3 is provided at an upper portion of the helmet windshield 1.

The sunshade device 3 includes a supporting slice 31 which is not transparent, a pushing block 32, a slider 33, a pivotal block 34, and a sunshade slice 35. At the center of the supporting slice 31 is formed an intermediate opening 311, and to one side of the opening 311 is provide an engagement hole 312 having the polygonal shape shown. At the center of the inner surface of the supporting slice 31 and surrounding the opening 311 is formed a sliding groove 313, and each end of the supporting slice 31 is provided with a stopping post 314. The pushing block 32 is provided with a protrusive member 321 on the inner surface. The slider 33 is substantially X-shaped and provided with a slider post 331 on its inner surface. Extending from an end section of the pivotal block 34 is a pivotal post having a protrusion 341 of a polygonal shape corresponding to the predetermined polygonal contour of the engagement hole 322 of the supporting slice 31. At one side of the protrusion 341 is formed a passing hole 342 whose inner diameter is the same as the outer diameter of the post 331 of the slider 33, and at an opposing end of the pivotal block 34 is formed a slotted hole having a long hole portion 343 extending from a rounded hole portion 3431. The inner diameter of the rounded hole portion is bigger than the width of the long hole portion 343, and the rounded hole portion 3431 communicates with the long hole portion 343.

At a portion of the outer surface of the sunshade slice 35 is provided a flat head rivet 351. The outer diameter of the shaft of the rivet 351 is the same as the inner diameter of the long hole portion 343 of the pivotal block 34 slotted hole, and the outer diameter of the head 3511 of the rivet 351 is the same as the inner diameter of the rounded hole portion 3431 of the pivotal bock 34 slotted hole. At each end of the sunshade slice 35 is provide a catching hole 352.

Figure 3:
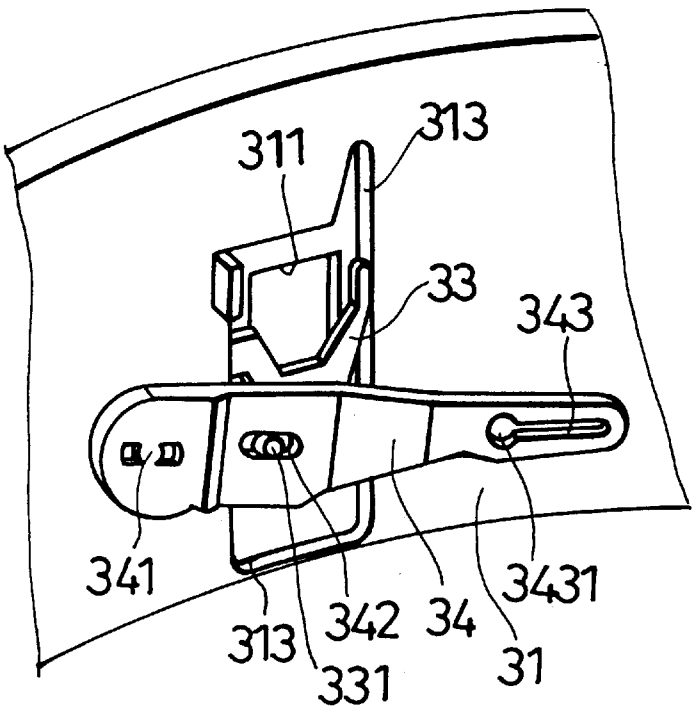
FIG. 3 is a perspective schematic view of the slider being inlaid in the sliding groove of the supporting slice in accordance with the present invention.
Figure 4:
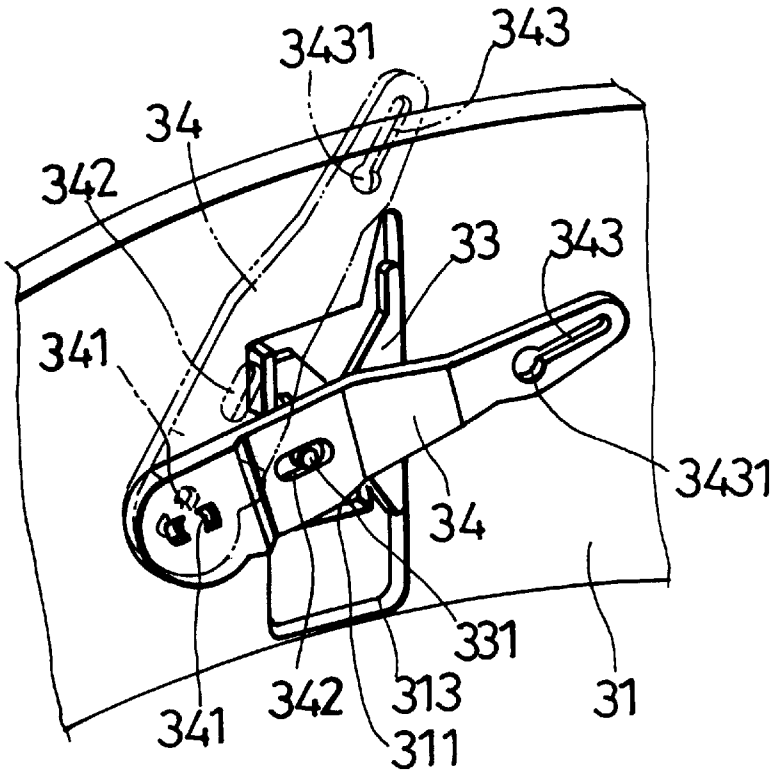
FIG. 4 is a perspective schematic view of the pivotal block combined with the supporting slice and slider in accordance with the present invention.

When assembled, the pushing block 32 is attached to the center of the outer surface of the supporting slice 31 so as to cause the protrusive member 321 of the pushing block 32 to insert into the intermediate opening 311 of the supporting slice 31 and attach to the slider 33. Opposing sides of the slider 33 are inlaid in the sliding groove 313 to enable the slider 33 to slide upward or downward in the sliding groove 313, as shown in FIG. 3. The protrusion 341 of the pivotal block 34 is inserted through the engagement hole 312 of the supporting slice 31, and the slider post 331 on the inner surface of the slider 33 is inserted into the hole 342 of the pivotal block 34, as shown in FIG. 4.

The flat head 3511 of the rivet 351 in the outer surface of the sunshade slice 35 is inserted in the rounded hole portion 3431 of the slotted hole communicating with the long hole portion 343 to enable the rivet 351 to be secured in the long hole 343 and pivotally combine the sunshade slice 35 with the pivotal block 34. Each inserting post 111 of the pivotal member 11 at each end of the helmet windshield 1 is then captured in the catching hole 352 at each end of the sunshade slice 35.

Figure 5:
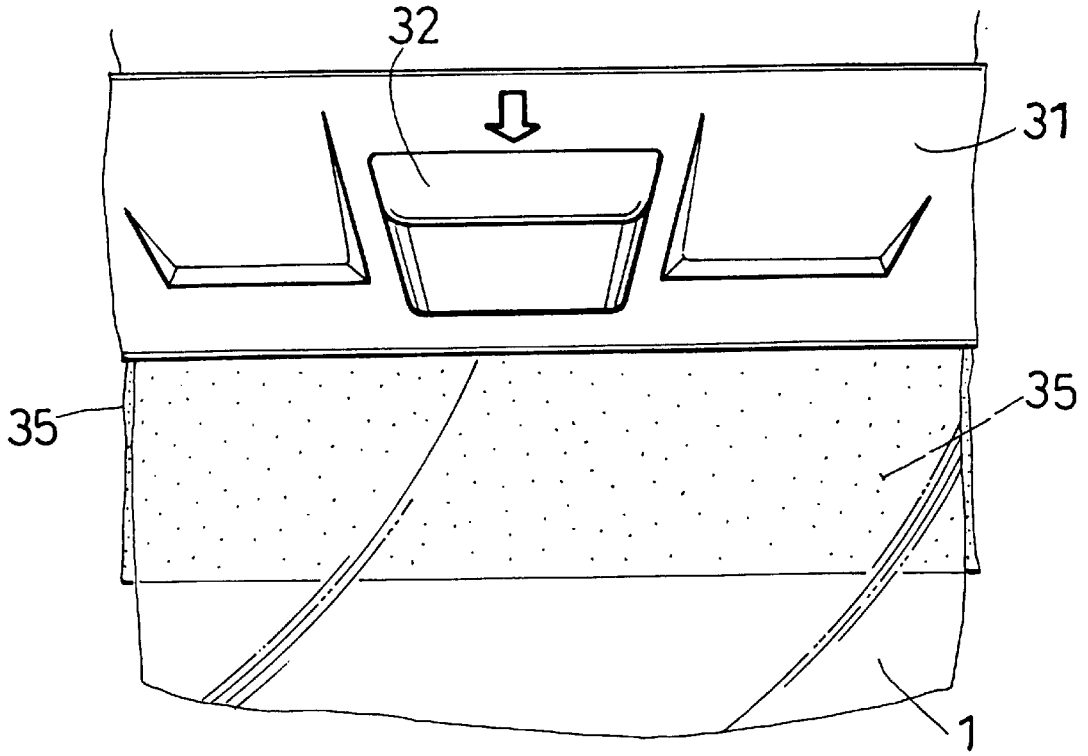
FIG. 5 is a schematic view showing the pushing block of the sunshade device in accordance with the present invention being pushed downward.
Figure 7:
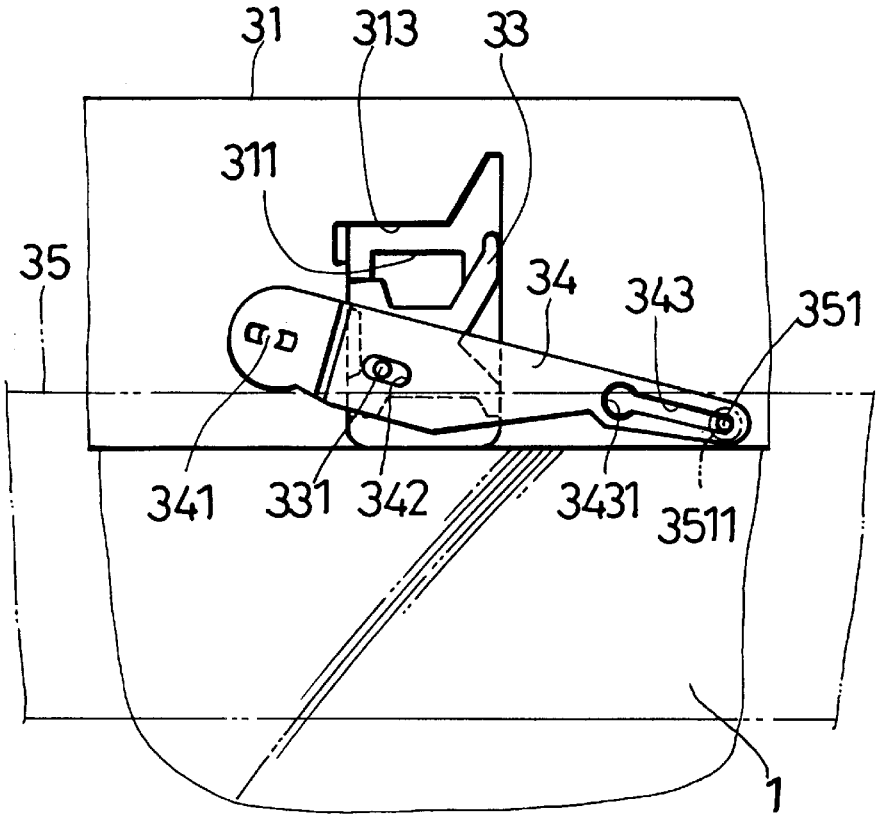
FIG. 7 is a schematic view of the sunshade device in accordance with the present invention in its activated configuration for use; and, FIG. 8 is a schematic view of the sunshade device in accordance with the present invention in its retracted configuration.

When use of the sunshade slice 35 is needed, the pushing block 32 is pushed downward, as shown in FIG. 5, causing the slider 33 to slide downward in the sliding groove 313. Because the post 331 of the slider 33 is secured in the hole 342 of the pivotal block 34 and because the pivotal post having the polygonal-shaped protrusion 341 is inserted through the correspondingly shaped engagement hole 312 of the supporting slice 31, the pivotal block 34 will move pivotally downward about the polygonal-shaped hole 312 responsive to the slider 33 sliding downward. Because the rivet 351 of the sunshade slice 35 is pivotally secured in the long hole portion 343 of the pivotal block 34 slotted hole, the sunshade slice 35 will move downward to shade an upper portion of the helmet windshield 1 responsive to the downward movement of the pivotal block 34, as shown in FIG. 7. Sunlight is thus shaded for the user.

Figure 6:
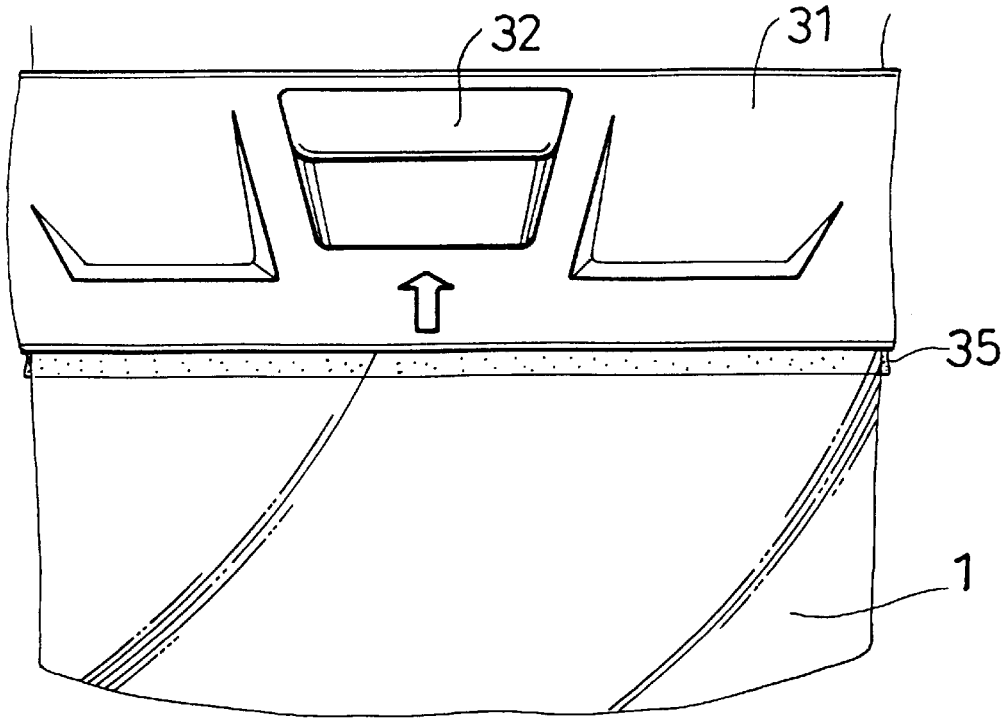
FIG. 6 is a schematic view showing the pushing block of the sunshade device in accordance with the present invention being pushed upward.
Figure 8:
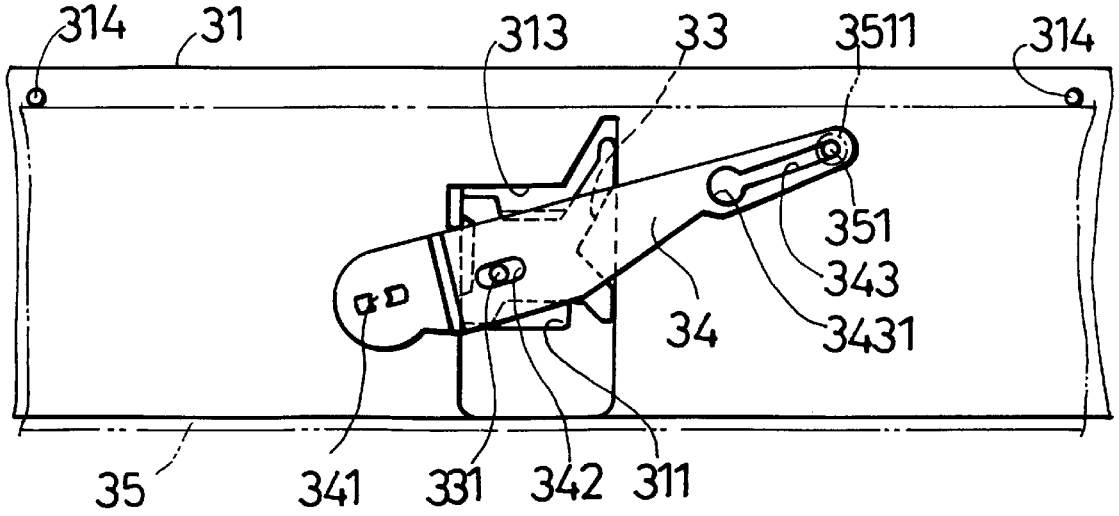

To retract the sunshade slice 35, the pushing block 32 is pushed upward, as shown in FIG. 6, so as to cause the sunshade slice 35 to move upward along the inner side of the supporting slice 31 accordingly. The sunshade slice 35 is stopped by the two supporting posts 314 protruding from the inner surface of the supporting slice 31, as shown in FIG. 8.

While preferred embodiments of the invention have been described above, it will be recognized and understood that various modifications may be made therein, and the appended claims are intended to cover all such modification which may fall within the spirit and scope of the invention.

What is claimed is:

1. An adjustably sunshaded windshield assembly for a helmet comprising:

(a) a transparent windshield adapted to be pivotally coupled the helmet, said windshield having at least one inserting post protruding therefrom;

(b) a supporting slice having opposed inner and outer surfaces coupled to said windshield, said supporting slice having formed therethrough an intermediate opening and an engagement hole adjacent thereto, said engagement hole having a predetermined polygonal contour, said supporting slice having formed in said inner surface about said intermediate opening a sliding groove, said supporting slice having at least one stopping post protruding therefrom;

(c) a slider slidably engaging said sliding groove of said supporting slice, said slider having a substantially X-shaped contour and a slider post protruding therefrom;

(d) a pushing block coupled to said slider through said intermediate opening of said supporting slice for actuating displacement thereof within said sliding groove, said pushing block being displaceable relative to said supporting slice;

(e) a pivotal block pivotally coupled to said supporting slice for pivotal displacement responsive to the displacement of said slider, said pivotal block having a pivotal post for engaging said engagement hole of said supporting slice, a portion of said pivotal post having a sectional contour corresponding to said predetermined polygonal contour of said engagement hole for engaging said engagement hole in releasably locked manner, said pivotal block having formed therein offset from said pivotal post a slotted hole and a passing hole, said passing hole engaging said slider post, said slotted hole having a rounded portion and an elongate portion extending in open communication therefrom; and (f) a sunshade slice pivotally coupled to said windshield for reversible displacement between first and second positions, said sunshade slice extending across at least a portion of said windshield in said first position, said sunshade slice having protruding therefrom a rivet member including head and shaft portions for slidably engaging said slotted hole of said pivotal block in releasable manner, said sunshade slice having formed thereon at least one catching hole for pivotally engaging said inserting post of said windshield, said sunshade slice being stopped in said second position by said stopping post of said supporting slice.

2. The adjustably shaded windshield assembly as recited in claim 1 wherein said predetermined polygonal contour includes a plurality of arcuate segments, adjacent ones of said arcuate segment being joined by a cusped portion.

* * * * *